US010138706B2

(12) United States Patent
Baihly et al.

(10) Patent No.: US 10,138,706 B2
(45) Date of Patent: Nov. 27, 2018

(54) COMPLETING A MULTI-STAGE WELL

(71) Applicant: Schlumberger Technology Corporation, Sugar Land, TX (US)

(72) Inventors: Jason Baihly, Katy, TX (US); Michael Bertoja, Bellaire, TX (US); Robert A. Parrott, Sugar Land, TX (US); Bruno Lecerf, Houston, TX (US); Don Aldridge, Manvel, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 479 days.

(21) Appl. No.: 14/711,379

(22) Filed: May 13, 2015

(65) Prior Publication Data

US 2015/0247378 A1 Sep. 3, 2015

Related U.S. Application Data

(63) Continuation of application No. 13/231,729, filed on Sep. 13, 2011, now Pat. No. 9,033,041.

(51) Int. Cl.

| | |
|---|---|
| ***E21B 23/01*** | (2006.01) |
| ***E21B 34/14*** | (2006.01) |
| ***E21B 43/14*** | (2006.01) |
| ***E21B 34/06*** | (2006.01) |
| ***E21B 23/04*** | (2006.01) |
| ***E21B 43/114*** | (2006.01) |
| *E21B 34/00* | (2006.01) |

(52) U.S. Cl.

CPC ..... *E21B 34/063* (2013.01); *E21B 23/04* (2013.01); *E21B 34/14* (2013.01); *E21B 43/114* (2013.01); *E21B 43/14* (2013.01); *E21B 2034/002* (2013.01)

(58) Field of Classification Search

CPC ..... E21B 23/04; E21B 34/14; E21B 43/14; E21B 23/01; E21B 23/06

USPC ..... 166/376, 63, 297, 55.2, 77.2, 318, 166/250.12, 250.04, 250.11; 89/1.15; 102/313

See application file for complete search history.

(56) References Cited

U.S. PATENT DOCUMENTS

| | | | | |
|---|---|---|---|---|
| 5,845,712 | A * | 12/1998 | Griffith, Jr. | E21B 33/12 166/278 |
| 6,349,766 | B1 * | 2/2002 | Bussear | E21B 33/127 166/113 |
| 7,021,389 | B2 * | 4/2006 | Bishop | E21B 34/14 166/317 |
| 7,896,091 | B2 * | 3/2011 | Williamson | E21B 33/1208 166/133 |
| 9,033,041 | B2 * | 5/2015 | Baihly | E21B 23/04 166/250.04 |
| 2014/0014371 | A1 * | 1/2014 | Jacob | E21B 33/129 166/382 |
| 2014/0202708 | A1 * | 7/2014 | Jacob | E21B 23/01 166/376 |

* cited by examiner

*Primary Examiner* — Kenneth L Thompson

(57) ABSTRACT

A technique includes running a seat assembly on a conveyance line into a tubing string, which has previously been installed in a well. The seat assembly includes a seat, which is adapted to receive an untethered object. The technique includes attaching the seat assembly to the string at a location downhole in the well; receiving the object to create a fluid barrier; and diverting fluid using the fluid barrier.

17 Claims, 6 Drawing Sheets

COMPLETING A MULTI-STAGE WELL

CROSS-REFERENCE TO RELATED APPLICATIONS

This application claims priority to and is a Continuation Application of U.S. patent application Ser. No. 13/231,729, filed Sep. 13, 2011, now U.S. Pat. No. 9,033,041 issued May 19, 2015, which is incorporated herein by reference in its entirety.

BACKGROUND

For purposes of preparing a well for the production of oil or gas, at least one perforating gun may be deployed into the well via a deployment mechanism, such as a wireline or a coiled tubing string. The shaped charges of the perforating gun(s) are fired when the gun(s) are appropriately positioned to perforate a casing of the well and form perforating tunnels into the surrounding formation. Additional operations may be performed in the well to increase the well's permeability, such as well stimulation operations and operations that involve hydraulic fracturing. All of these operations typically are multiple stage operations, which means that each operation typically involves isolating a particular zone, or stage, of the well, performing the operation and then proceeding to the next stage. Typically, a multiple stage operation involves several runs, or trips, into the well.

SUMMARY

In an embodiment, a technique includes running a seat assembly on a conveyance line into a tubing string, which has previously been installed in a well. The seat assembly includes a seat, which is adapted to receive an untethered object. The technique includes attaching the seat assembly to the string at a location downhole in the well; receiving the object to create a fluid barrier; and diverting fluid using the fluid barrier.

DETAILED DESCRIPTION

In the following description, numerous details are set forth to provide an understanding of the implementations that are disclosed herein. However, it will be understood by those skilled in the art that the scope of the appended claims is not to be limited by these details, as numerous variations or modifications from the described embodiments are possible and are within the scope of the appended claims.

As used herein, terms, such as "up" and "down"; "upper" and "lower"; "upwardly" and downwardly"; "upstream" and "downstream"; "above" and "below"; and other like terms indicating relative positions above or below a given point or element are used in this description to more clearly describe some embodiments. However, when applied to equipment and methods for use in environments that are deviated or horizontal, such terms may refer to a left to right, right to left, or other relationship as appropriate.

In general, systems and techniques are disclosed herein for purposes of performing stimulation operations (fracturing operations, acidizing operations, etc.) in multiple zones, or stages, of a well using seat assemblies that are run downhole inside a previously-installed tubing string and are secured to the tubing string at desired locations in the well in which the stimulation operations are to be performed. The seat assembly includes a seat that is constructed to receive (or "catch") an untethered object (an activation ball or a dart, as non-limiting examples) for purposes of forming a fluid tight barrier (also referred to as a "fluid barrier" herein) in the string. Depending on the particular embodiment, the untethered object may be deployed with the seat assembly (i.e., disposed in a seat of the assembly) as a unit; or alternatively, the seat assembly and object may be deployed separately: the seat assembly may be deployed and installed in the tubing string first, and thereafter, the untethered object may be communicated through the passageway of the tubing string (dropped from the Earth surface, for example) to cause the object to land in the seat. The fluid barrier allows fluid in a given stage to be diverted, and this fluid diversion may be used in connection with a given stimulation operation. For example, fluid may be diverted above the barrier in the tubing string and into the surrounding formation region being fractured in a hydraulic fracturing operation.

Figure 1:
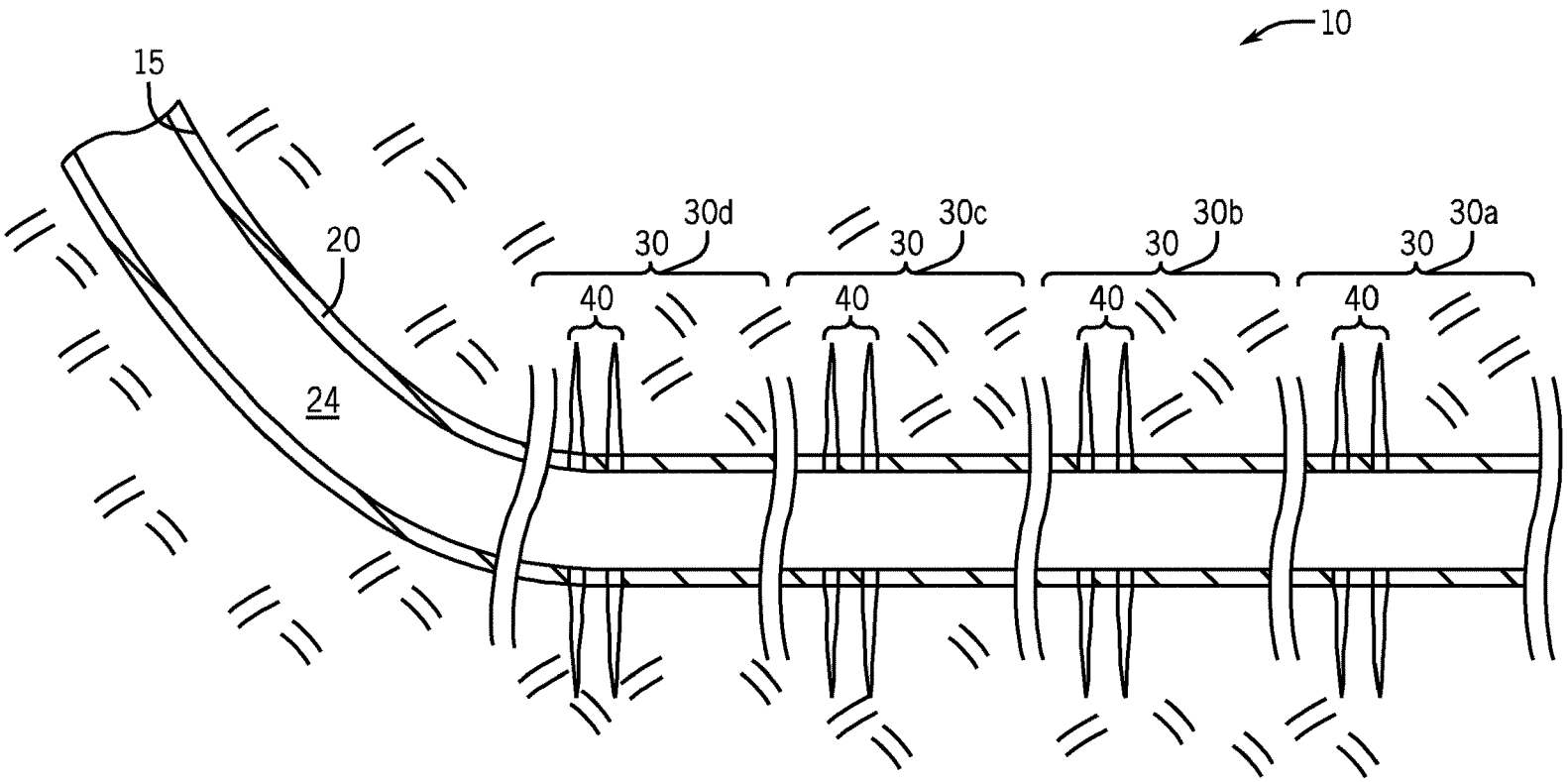
FIGS. 1 and 4 schematic diagrams of a well, which illustrate the use of a conveyance line-deployable seat assembly to form a fluid tight barrier in a tubing string and the use of the barrier to perform a stimulation operation in a stage of the well according to embodiments.

Referring to FIG. 1, as a more specific non-limiting example, in accordance with some embodiments, a well 10 includes a wellbore 15, which traverses one or more producing formations. For the non-limiting examples that are disclosed herein, the wellbore 15 is lined, or supported, by a tubing string 20, as depicted in FIG. 1. The tubing string 20 may be cemented to the wellbore 15 (such wellbores are typically referred to as "cased hole" wellbores), or the tubing string 20 may be secured to the formation by packers (such wellbores are typically referred to as "open hole" wellbores). In general, the wellbore 15 extends through one or multiple zones, or stages 30 (four exemplary stages 30*a*, 30*b*, 30*c* and 30*d* being depicted in FIG. 1, as non-limiting examples), of the well 10.

It is noted that although FIG. 1 and the subsequent figures depict a lateral wellbore 15, the techniques and systems that are disclosed herein may likewise be applied to vertical wellbores. Moreover, in accordance with some embodiments, the well 10 may contain multiple wellbores, which contain tubing strings that are similar to the illustrated tubing string 20. Thus, many variations are contemplated and are within the scope of the appended claims.

In the following examples, it is assumed that the stimulation operations are conducted in a direction from the toe end to the heel end of the wellbore 15. However, it is understood that in accordance with other embodiments, the stimulation operations may be performed in a different direction and may be performed, in general, at any given stage 30 in no particular directional order. FIG. 1 also depicts that fluid communication with the surrounding reservoir is enhanced through sets 40 of perforation tunnels that are formed in each stage 30 (through one or more previous perforating operations) and extend through the tubing string 20 into the surrounding formation(s). It is noted that each stage 30 may have multiple sets of perforation tunnels 40. Moreover, the perforation tunnels 40 are shown merely as an example of one way to establish/enhance fluid communication with the reservoir, as the fluid communication be established/enhanced through any of a wide variety of techniques, such as communicating an abrasive slurry that perforates the tubing string wall; firing shaped charges to produce perforating jets that perforate the tubing string wall; opening sleeve valves of the tubing string 20, and so forth.

Figure 2:
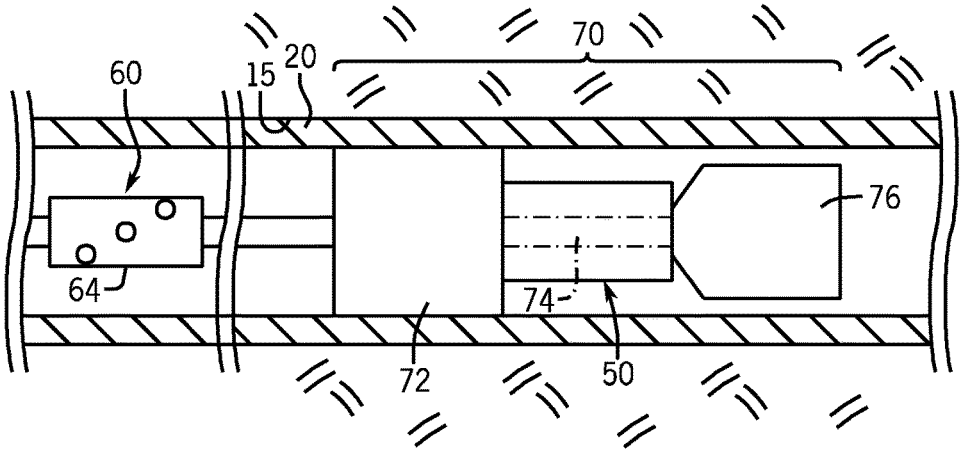
FIG. 2 is a schematic diagram illustrating installation of the seat assembly in the tubing string using an expander tool according to embodiments.

Referring to FIG. 2 in conjunction with FIG. 1, for purposes of performing a stimulation operation in a given stage 30, a seat assembly 50 is first run downhole inside the central passageway 24 of the tubing string 20 on a conveyance line (a conveyance line, such as a coiled tubing string 60 as shown or alternatively, a coiled tubing string, slickline, wireline, etc., as non-limiting examples) and installed at a desired location in the string 20 at which the stimulation operation is to be performed. In this manner, as an example, to perform a stimulation operation in the stage 30*a*, the seat assembly 50 may be installed in the tubing string 20 near the bottom, or downhole end, of the stage 30*a*. Once installed inside the tubing string 20, the combination of an object catching seat of the seat assembly 50 and an object that is received in the seat form a fluid tight barrier to divert fluid in the tubing string 20 uphole of the fluid barrier.

FIG. 2 depicts the use of an expander tool 70 to illustrate one way in which the seat assembly 50 may be installed at a desired location inside the tubing string 20 in accordance with some embodiments. In this manner, for this non-limiting example, the seat assembly 50 is run downhole on the string 60 on the expander tool 70. In general, the expander tool 70 includes an anchor 72 (a hydraulically-set anchor, for example), which forms a temporary connection to the interior wall of the tubing string 20 to temporarily anchor the tool 70 in place for purposes of setting the seat assembly 50 in place. For this example, in its run-in-hole state, the seat assembly 50 has a smaller overall outer diameter than the inner diameter of the tubing string 20, which facilitates running the seat assembly 50 into the tubing string 20. As an example, a housing of the seat assembly 50 may be partially collapsed in the run-in-hole state.

For the example that is depicted in FIG. 2, when run into the tubing string 20, the seat assembly 50 is disposed between the anchor 72 and a tapered expander 76 of the expander tool 70. An operator mandrel 74 extends through the seat assembly 50 such that when the expander tool 70 operates to set the seat assembly 50, the tool 70 retracts the mandrel 74 to pull the expander 76 through the interior of the seat assembly 50, which forces the assembly 50 to radially expand. As depicted in FIG. 2, in accordance with some embodiments, the string 60 may contain at least one perforating gun 64 for purposes of perforating the tubing string 20 prior to or after installation of the seat assembly 50.

It is noted that FIG. 2 depicts one out of many possible tools that may be used to initially set the seat assembly 50 in place in a desired location downhole, as other tools and/or seat assemblies may be used to set the seat assembly in place at the desired downhole location, in accordance with other embodiments. For example, the seat assembly 50 may be installed without using an anchor. In this manner, the seat assembly 50 may be expanded without any anchoring, or alternatively, the seat assembly 50 may be expanded by passing a triggering feature, or profile, of the string 20. As another example, in accordance with other embodiments, the seat assembly may be radially expanded by compressing a tubular housing of the seat assembly between opposing pistons, or thimbles. As another example, the seat assembly may have peripherally-disposed dogs, which are expanded by a setting tool for purposes of "biting" into the interior wall of the tubing string 20 to secure the seat assembly 50 to the wall of the tubing string 20. As yet another example, in accordance with other embodiments, the seat assembly may have an outer resilient ring, which is compressed for purposes of sealing and securing the body of the seat assembly to the tubing string 20. Thus, many variations are contemplated and are within the scope of the appended claims.

Figure 7:
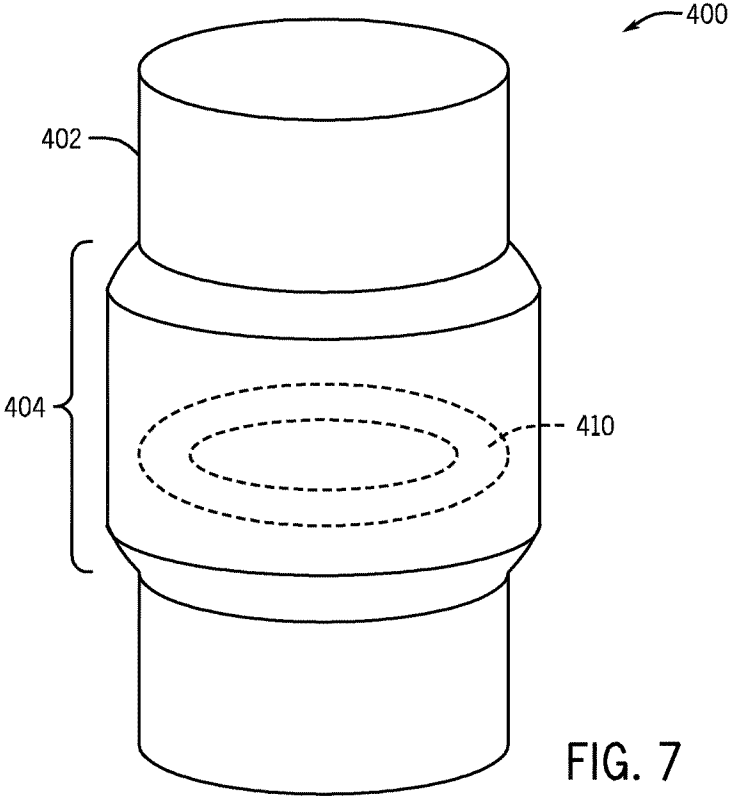
FIG. 7 is a perspective view of a seat assembly according to another embodiment.

In some embodiments, a seat assembly 400 that is depicted in FIG. 7 may be employed. Unlike the above-described seat assemblies, which may be disposed at relatively arbitrary locations inside the tubing string 20, the seat assembly 400 has an outer profile 404 that extends outwardly from a housing 402 of the seat assembly 400 for purposes of engaging a corresponding interior surface profile of the tubing string 20. Thus, the seat assembly 400 may be deployed at a predetermined positioned in the tubing string 20, which is controlled by a seat assembly locating profile of the string 20.

As a non-limiting example, the outer profile 404 may be formed from a collet, which may be activated, for example, when the seat assembly 400 is near the desired inner surface profile of the tubing string 20. In this manner, when activated, the seat assembly 400 releases an otherwise restrained collet 410 for purposes of engaging the outer profile 404 with the corresponding inner surface profile of the tubing string 20.

Figure 3:
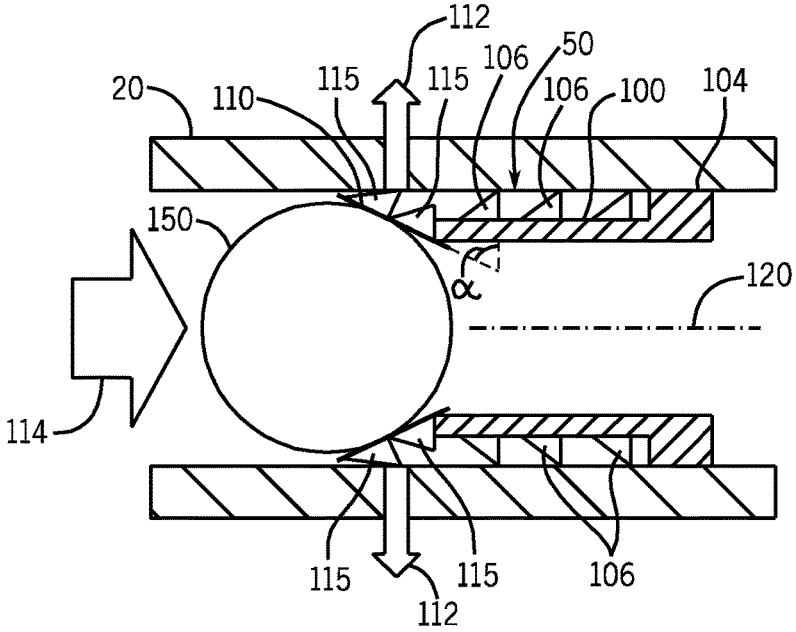
FIG. 3 is a more detailed schematic diagram of the seat assembly according to embodiments.

As yet another example, in accordance with some embodiments, a seat assembly may be set or at least partially set in place inside the tubing string 20 using a force that results from the fluid barrier created by the object that is disposed in the seat of the assembly. For example, FIG. 3 generally depicts a schematic view of a seat assembly 50 in accordance with some implementations. As shown in FIG. 3, the seat assembly 50 includes a tubular housing 100 that is generally concentric with the tubing string 20 near the seat assembly 50 and is generally concentric with a longitudinal axis 120 of the string 20.

Depending on the particular embodiment, the seat assembly 50 may be initially set in position inside the tubing string 20 by any of the above-mentioned techniques. In accordance with some embodiments, the seat assembly 50 contains radially expandable teeth 106 that are distributed around the outer perimeter of the housing 100 for purposes of initially securing the seat assembly 50 to the tubing string wall. As non-limiting examples, the teeth 106 may be part of dogs that are peripherally disposed around the housing 100 and are expanded using a setting tool on the conveyance line that runs the seat assembly 50 into the tubing string 20. In this regard, the teeth may be made of a relatively hard material, such as tungsten carbide, which is harder than the material that forms the wall of the tubing string 20 to thereby allow the teeth 106 to "bite" into the tubing string wall when the dogs are radially expanded.

As depicted in FIG. 3, the seat assembly 50 further includes an object catching seat 110 that generally is inclined at an angle $\alpha$ (an angle of 45 degrees, for example) with respect to the cross-sectional plane that extends through the tubing string passageway 24. Due to this inclination, when an activation object, such as an activation ball 150, is received in the seat 110, as depicted in FIG. 3, the resulting fluid barrier may be used to communicate a force to set/further set the seat assembly 50. In this manner, a column of fluid in the tubing string 20 above the activation ball 150 may exert a downward force 114 on the activation ball 150; and the inclined seat 110 redirects the force 114 to produce forces 112 that are directed in radial outward directions. These radially-directed forces 112, in turn, are used to drive teeth 115 of the seat assembly 50 into the wall 104 of the tubing string 20.

Similar to the teeth 106, the teeth 115 may be made of a relatively hard material, such as tungsten carbide, and may have relatively sharp outer profiles that "bite" into the tubing string wall. Due to the radial expansion of the seat 110 and the radial expansion of the teeth 110, a fluid seal is formed between the seat 110 and the tubing string wall 104 and the seat assembly 50 is set/further set into position inside the tubing string 20.

Figure 4:
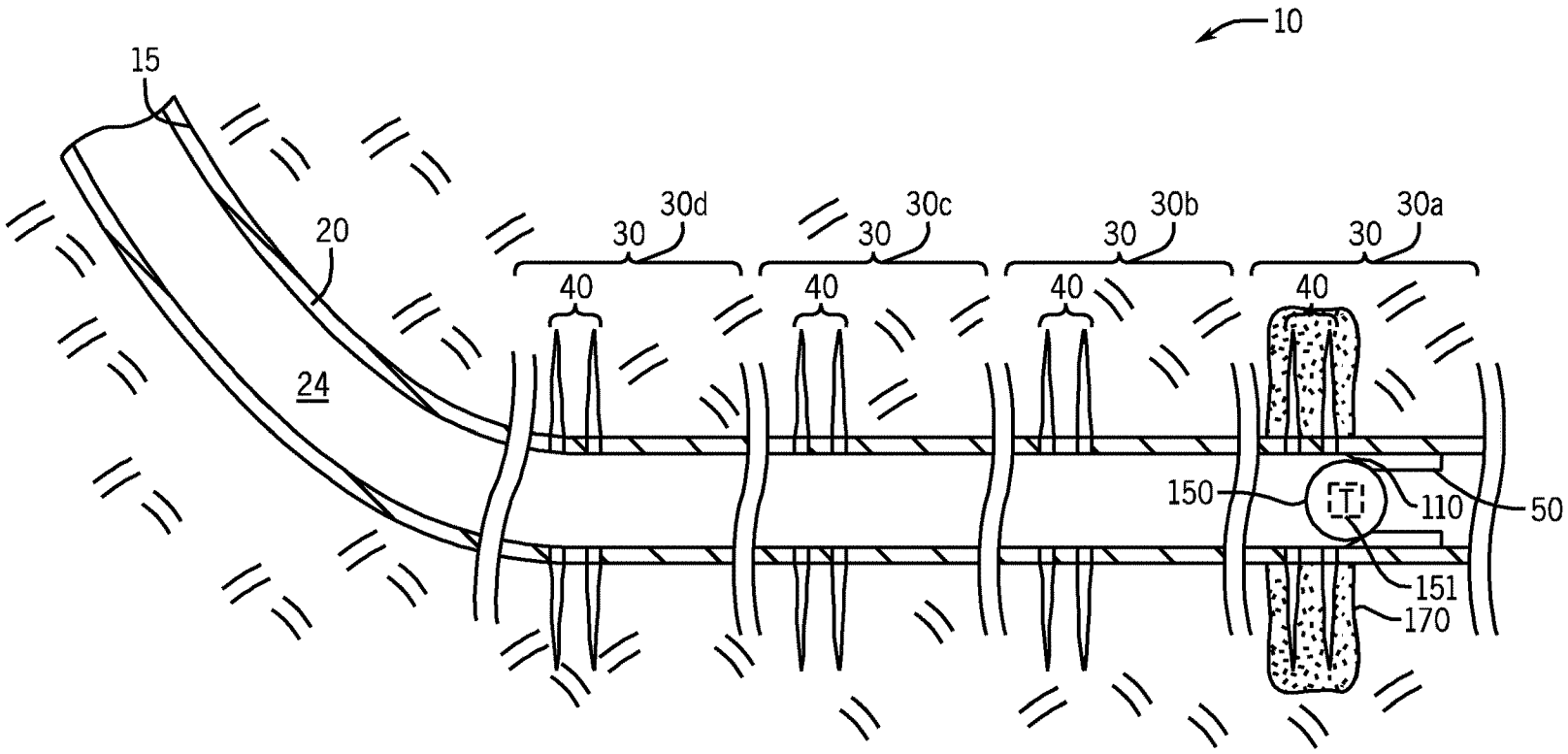

FIG. 4 depicts an exemplary stimulation operation in the stage 30*a* using the seat assembly 50, although any of the other seat assemblies that are disclosed herein as well other seat assemblies of other designs may alternatively be used, in accordance with other embodiments. In accordance with embodiments, a stimulation operation in the stage 30*a* begins by running the seat assembly 50 into the tubing string 20 and setting the assembly 50 at a given position in the tubing string 20 near the bottom of the stage 30*a*. The setting results in the attachment of the seat assembly 50 to the tubing string 20.

After installation of the seat assembly 50 in the tubing string 20, an untethered object, such as the activation ball 150 that is depicted in FIG. 4, may be deployed through the central passageway 24 of the tubing string 20. It is noted that the activation ball 150 may be deployed from the Earth surface of the well 10, or in accordance with other embodiments, the activation ball 150 may be deployed from another tool that is already disposed inside the central passageway 24. As a non-limiting example, the activation ball 150 may be deployed from a tool that is disposed at the bottom end of a perforating gun, for example. The deployment of the activation ball 150 may involve allowing the ball 150 to free fall or pumping the ball 150 downhole using fluid, depending on the particular implementation. Moreover, as noted above, in accordance with other embodiments, the activation ball 150 may be deployed as a unit with the seat assembly 50.

As shown in FIG. 4, when the ball 150 is received in the seat 110 of the seat assembly 50, a fluid barrier is created such that fluid may be diverted above the barrier. For the example that is depicted in FIG. 4, fluid is diverted in a fracturing operation to the region above the activation ball 150 to create a corresponding fractured region 170 around a set 40 of perforation tunnels.

After the stimulation operation in the stage 30*a* is complete, an operation may be undertaken for purposes of removing the activation ball 150 from the seat 110 to restore communication through the tubing string 20. For example, in accordance with some embodiments, a milling tool may be run into the central passageway 24 of the tubing string 20 for purposes of engaging and disintegrating the seated activation ball 150. Alternatively, as another non-limiting example, the activation ball 150 may be constructed from a dissolvable material (an aluminum or aluminum alloy material, for example) that dissolves in the well environment due to corrosive well fluids at a relatively rapid rate (within a few days, weeks or months). A fluid (acid, for example) may be introduced into the well to dissolve and/or further enhance the degradation of the activation ball 150.

In some embodiments, the seat of the seat assembly 50 may be made from a dissolvable material, such as an aluminum or aluminum alloy, for purposes of disintegrating the seat, which permits the passage of the activation ball 150 through the deteriorated seat. As yet another example, the activation ball 150 and the seat of the seat assembly 50 may each be made from dissolvable materials such that upon sufficient disintegration of the seat and activation ball 150, fluid communication through the seat assembly 50 is restored, and the original full inside diameter is restored, leaving no reduction in the internal diameter of the tubing string 20.

As yet another example, in accordance with other embodiments, a mechanism that secures, or anchors the seat assembly 50 to the tubing string wall may be made of a dissolvable material that disintegrates relatively rapidly to allow the entire seat assembly 50 to fall downhole. In this manner, a mechanism securing dogs to the main housing of the seat assembly 50 may be made of a dissolvable material, in accordance with some embodiments. As yet another variation, in accordance with other embodiments, the seat assembly may be constructed with a releasable latch that permits the assembly to be retrieved from the well upon engagement with a release tool that is run into the well. Thus, many variations are contemplated and are within the scope of the appended claims.

Completion operations may be performed in the other stages 30 in a similar manner. For example, another seat assembly 50 may be run downhole and installed in the stage 30*b* for purposes of performing a completion operation in the stage 30*b* and so forth.

Figure 5:
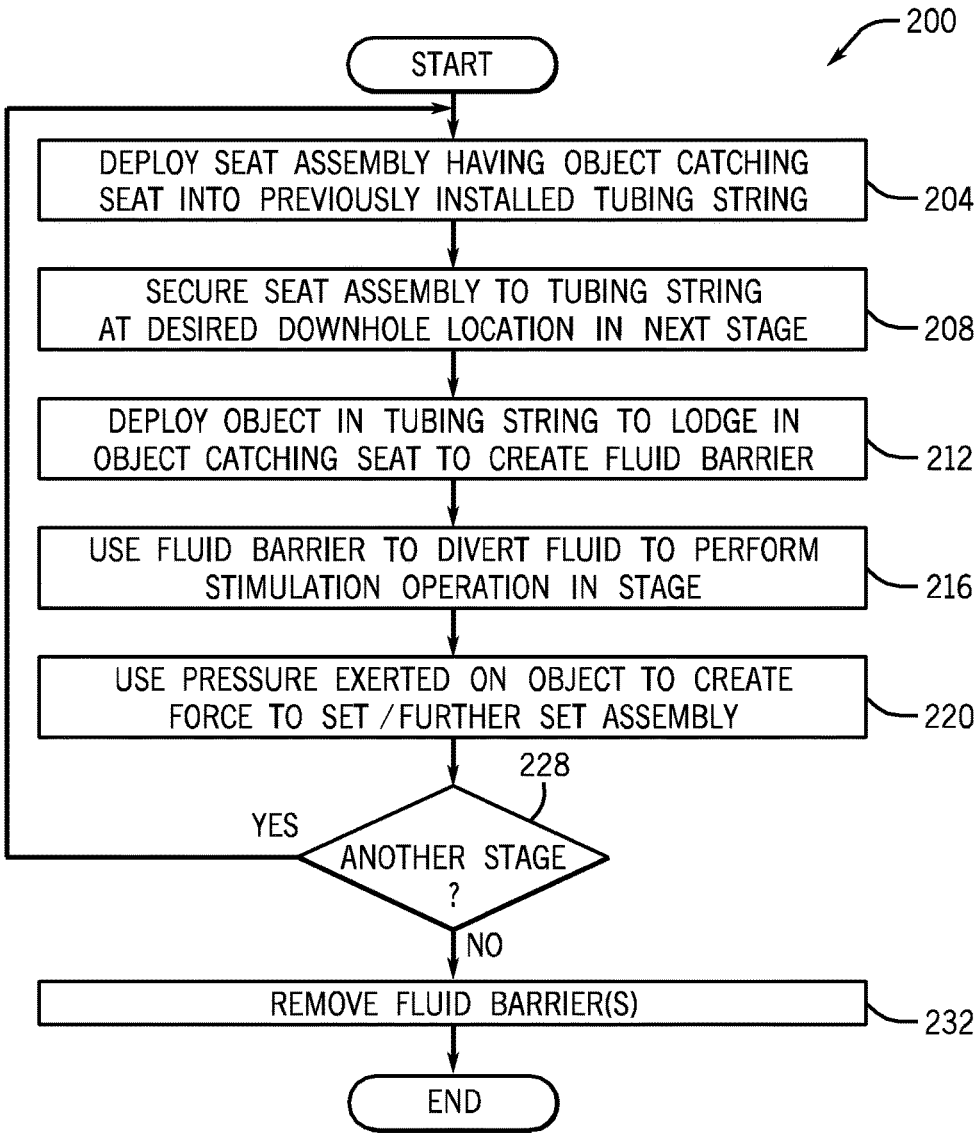
FIG. 5 is a flowchart of a technique to install and use seat assemblies in a tubing string of a well for purposes of performing stimulation operations in different stages of the well according to embodiments.

Referring to FIG. 5, therefore, in accordance with some embodiments, a technique 200 includes deploying (block 204) a seat assembly in a tubing string in a well and securing (block 208) the seat assembly to the tubing string 20 at a desired downhole location in the next stage 30 in which a stimulation operation is to be performed. The technique 100 includes deploying (block 212) an object in the tubing string (with or after the deployment of the seat assembly) to land in the object catching seat to create a fluid barrier and using the fluid barrier to divert fluid in the tubing string to perform a stimulation operation in the stage, pursuant to block 216. In accordance with some implementations, pressure that is exerted on the object due to the fluid barrier may be used to set or further set the seat assembly, pursuant to block 220. A determination may then be made (diamond 228) whether a completion operation is to be performed in another stage. If so, control returns to block 204, where another seat assembly 50 is deployed into the tubing string 20. If not, the fluid barrier(s) are then removed, pursuant to block 232.

Although the installation and use of a single seat assembly 50 is illustrated in the figures, it is understood that multiple seat assemblies 50 may be installed in a given stage 30, in accordance with other implementations. In general, an unlimited number of seat assemblies 50 (forty to fifty, as a non-limiting exemplary range) may be installed in the tubing string 20 and in other tubing strings of the well in order to effect stimulation operations in a correspondingly unlimited number of stages or zones in the wellbore formation(s).

Figure 6:
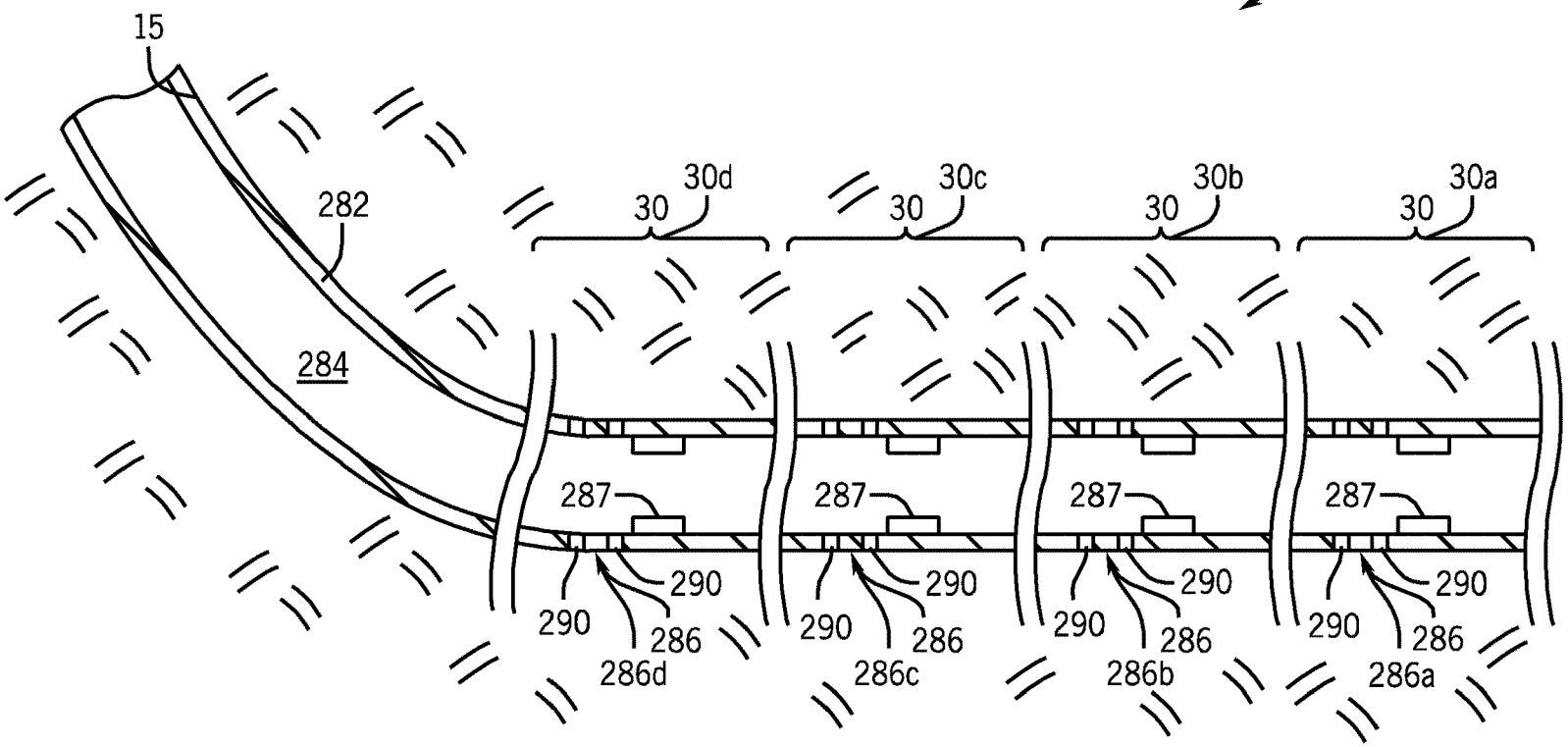
FIG. 6 is a schematic diagram of a well, which illustrates a tubing string according to embodiments.

Referring to FIG. 6, in accordance with other embodiments, an alternative tubing string 282 (which replaces the tubing string 20 shown in FIGS. 1 and 4) may be used in a well 280 in lieu of the tubing string 20. In general, FIG. 6 contains similar reference numerals corresponding to similar elements discussed above, with the different elements being represented by different reference numerals. The tubing string 282 contains sleeve valves 286 (sleeve valves 286*a*, 286*b*, 286*c* and 286*d*, being depicted in FIG. 6 as non-limiting examples), which may be used to establish/enhance reservoir communication. For this example, each sleeve valve 286 contains a sliding interior sleeve 287 that may be operated (via a shifting tool, for example) for purposes of opening and closing fluid communication through the sleeve valve 286. More specifically, in accordance with some embodiments, the sleeve valve 286 opens and closes fluid communication through corresponding radial ports 290 that are formed in the wall of the tubing string 282. As depicted in FIG. 6, in accordance with some embodiments, the tubing string 282 is either installed downhole with all of the sleeve valves 286 open or the valves may be subsequently opened before the stimulation operations begin by the appropriate valve operating tool being run into a passageway 284 of the tubing string 282.

Other variations are contemplated and are within the scope of the appended claims. For example, referring back to FIG. 4, in accordance with some embodiments, the activation ball 150 may contain a cavity that houses a tracer 151 as long as the ball 150 remains intact. In general, the tracer 151 is used for purposes of furnishing a stimulus to confirm whether degradation of the ball 150 has occurred, for embodiments in which the ball 150 is made from a dissolvable material. In this manner, upon sufficient degradation of the activation ball 150, the tracer 151 is released, which permits its detection. As a non-limiting example, the tracer 151 may contain a fluid (a radioactive particle-laden fluid, for example), which may be detected by downhole sensors or may be detected by sensors at the Earth surface of the well. As another variation, in accordance with other embodiments, the tracer 151 may be a radio frequency identification (RFID) tag, which may be detected by downhole RFID readers or by RFID readers that are disposed near the Earth surface. As yet another variation, in accordance with some implementations, the activation ball 150 may contain an identifying portion (a portion having a unique shape such as a small metal coin with an engraved identification, for example) that is not dissolvable, which allows the portion to be released due to sufficient degradation of the ball and therefore, be detected at the surface of the well. Thus, many variations are contemplated and are within the scope of the appended claims.

While a limited number of embodiments have been described, those skilled in the art, having the benefit of this disclosure, will appreciate numerous modifications and variations therefrom. It is intended that the appended claims cover all such modifications and variations.

What is claimed is:

1. A method comprising:

installing a tubing string having an interior wall into a well;

running a seat assembly into the tubing string;

attaching the seat assembly to the interior wall of the tubing string at a location in the well, the seat assembly providing a seat adapted to receive an untethered object, wherein the seat comprises a surface inclined at an acute angle with respect to a cross-sectional plane that extends through a passageway of a face of the tubing string to produce a radially directed outward force tending to force the seat assembly against the interior wall of the tubing string in response to a pressure being exerted on the object due to fluid pumped in the tubing string;

receiving the object in the seat of the seat assembly to create a fluid barrier;

diverting fluid for stimulation operations using the fluid barrier; and disintegrating at least part of the fluid barrier.

2. The method of claim 1, further comprising:

deploying the object though a passageway of the tubing string; and landing the object in the seat of the seat assembly.

3. The method of claim 1, further comprising running the object with the seat assembly as a unit into the tubing string.

4. The method of claim 1, wherein the attaching comprises:

radially expanding the seat assembly from a radially smaller size to a radially larger size to secure the seat assembly to the interior wall of the tubing string.

5. The method of claim 1, wherein the attaching comprises:

using a pressure exerted on the seat by the object to produce a force to radially expand the seat assembly against the interior wall of the tubing string.

6. The method of claim 1, wherein the attaching comprises:

teeth of the seat assembly biting into the interior wall of the tubing string.

7. The method of claim 1, further comprising:

perforating the tubing string.

8. The method of claim 7, wherein the perforating comprises running a perforating gun into the tubing string with the seat assembly attached to the perforating gun.

9. The method of claim 1, wherein disintegrating comprises an act selected from a group consisting of:

dissolving the object; and dissolving the seat assembly.

10. The method of claim 1, further comprising receiving a stimulus indicating at least part of the fluid barrier has been removed.

11. The method of claim 10, wherein the receiving of the stimulus indicating that at least part of the fluid barrier has been removed comprises an act selected from a group consisting of:

receiving a chemical tracer initially contained inside a cavity of the object and released due to at least partial disintegration of the object;

receiving a radio frequency identification tag at a radio frequency identification tag reader, the radio frequency identification tag being initially contained inside a cavity of the object and released due to at least partial disintegration of the object; and receiving an identifying portion of the object released due to at least partial disintegration of the object.

12. An apparatus comprising a seat assembly deployable downhole on a conveyance line inside a passageway of a tubing string previously installed in a well, the seat assembly adaptably attachable to an interior profile of the tubing string at a location in the well to form a seat adapted to receive an untethered object and thereby form a fluid barrier to divert fluid in the string, wherein the seat comprises a surface inclined at an acute angle with respect to a cross-sectional plane that extends through a passageway of a face of the tubing string to produce a radially directed outward force tending to force the seat assembly against a wall of the tubing string in response to a pressure being exerted on the object due to fluid pumped into the string, and wherein at least a portion of the seat assembly is made of a degradable material.

13. The apparatus of claim 12, wherein the seat assembly comprises radially expanding teeth to secure the seat assembly to the wall of the tubing string.

14. The apparatus of claim 12, wherein the seat assembly comprises an outer profile adapted to land in an inner surface profile of the tubing string.

15. The apparatus of claim 12, wherein the object comprises degradable material.

16. The apparatus of claim 12, wherein the seat assembly comprises a metal alloy.

17. The apparatus of claim 12, wherein the apparatus is operably coupleable with a tool adapted to secure the assembly to the tubing string, wherein the tool and a perforating gun are attached to the conveyance line.

* * * * *